US007266914B2

(12) United States Patent
Grant

(10) Patent No.: US 7,266,914 B2
(45) Date of Patent: Sep. 11, 2007

(54) WEAR PLATE ASSEMBLY

(75) Inventor: James Grant, Sudbury (CA)

(73) Assignee: Peninsula Alloy Inc., Thorold, Ontario (CA)

( * ) Notice: Subject to any disclaimer, the term of this patent is extended or adjusted under 35 U.S.C. 154(b) by 324 days.

(21) Appl. No.: 11/023,714

(22) Filed: Dec. 28, 2004

(65) Prior Publication Data

US 2005/0172524 A1 Aug. 11, 2005

Related U.S. Application Data

(63) Continuation-in-part of application No. 09/971,540, filed on Oct. 9, 2001, now abandoned.

(51) Int. Cl.
*E02F 3/96* (2006.01)

(52) U.S. Cl. ..... 37/446; 37/444; 37/448

(58) Field of Classification Search ..... 37/446, 37/444, 448, 449, 452, 454
See application file for complete search history.

(56) References Cited

U.S. PATENT DOCUMENTS

| | | | | |
|---|---|---|---|---|
| 2,841,896 | A | 7/1958 | Meshorer | |
| 2,965,989 | A | 12/1960 | Hibbard | |
| 3,312,004 | A | 4/1967 | Johnson | |
| 3,497,973 | A | 3/1970 | Campbell | |
| 3,550,293 | A | 12/1970 | Helton | |
| 3,685,177 | A | 8/1972 | Hahn et al. | |
| 3,736,664 | A | 6/1973 | Black et al. | |
| 3,845,578 | A * | 11/1974 | Holmstrom | 37/446 |
| 3,851,413 | A * | 12/1974 | Lukavich | 37/451 |
| 3,934,654 | A | 1/1976 | Stephenson et al. | |
| 3,967,398 | A | 7/1976 | Stepe | |
| 3,984,929 | A * | 10/1976 | Meyer et al. | 37/449 |
| 3,995,384 | A | 12/1976 | Wood | |
| 3,997,988 | A | 12/1976 | Klett | |
| 4,006,544 | A * | 2/1977 | Stepe | 37/448 |
| 4,052,803 | A | 10/1977 | Lanz et al. | |

(Continued)

FOREIGN PATENT DOCUMENTS

| | | |
|---|---|---|
| CA | 1057335 | 6/1979 |

(Continued)

OTHER PUBLICATIONS

Brochure—Quick Change for LHD Buckets, date unknown.

*Primary Examiner*—Thomas A Beach
(74) *Attorney, Agent, or Firm*—Sonnenschein Nath & Rosenthal LLP; Bryan P. Stanley

(57) ABSTRACT

A bucket assembly is provided with a kit that includes a base plate for permanent connection to a lower part of the bucket, and sacrificial, impermanent replaceable wear edge segments for the forward lip and corner leading edges of an excavator or loader bucket. These segments form a set of "bolt on" cast wear members and wing wear segments. The base plate and wear plates are drilled and machined to accommodate the precision fitting bolting on of the replaceable lips and cast wing segments. The cast lip segments are of both left and right hand configurations and come in a variety of widths that, in combination, may tend to fit a large number of different commercially available bucket sizes. The lip top and bottom faces are shaped in a profile that may tend to result in relatively uniform wear and a reduction in friction when digging into various materials.

29 Claims, 8 Drawing Sheets

U.S. PATENT DOCUMENTS

| | | | | |
|---|---|---|---|---|
| 4,069,604 | A | | 1/1978 | Stepe |
| 4,074,449 | A | * | 2/1978 | Lanz et al. ..... 228/114 |
| 4,238,896 | A | * | 12/1980 | Lanz et al. ..... 37/450 |
| 4,476,642 | A | | 10/1984 | Hemphill |
| 4,501,079 | A | | 2/1985 | Hahn et al. |
| 4,611,418 | A | | 9/1986 | Launder |
| 4,716,666 | A | | 1/1988 | Potter |
| 4,932,145 | A | | 6/1990 | Reeves, Jr. |
| 5,016,365 | A | | 5/1991 | Robinson |
| 5,088,214 | A | | 2/1992 | Jones |
| D345,364 | S | | 3/1994 | Robinson |
| 5,564,206 | A | | 10/1996 | Ruvang |
| 5,579,594 | A | | 12/1996 | Pasqualini et al. |
| 5,713,145 | A | | 2/1998 | Ruvang |
| 5,718,070 | A | | 2/1998 | Ruvang |
| 5,778,871 | A | | 7/1998 | Pasqualini et al. |
| 5,983,534 | A | | 11/1999 | Robinson et al. |
| 6,041,529 | A | | 3/2000 | Ruvang |
| 6,145,224 | A | | 11/2000 | Stickling |
| 6,209,238 | B1 | | 4/2001 | Ruvang |
| 6,230,424 | B1 | | 5/2001 | Renski et al. |
| 6,240,663 | B1 | | 6/2001 | Robinson |
| 6,360,458 | B2 | * | 3/2002 | Dolister ..... 37/195 |
| 6,415,533 | B2 | | 7/2002 | Bierwith |
| 6,446,368 | B1 | | 9/2002 | Watts |
| 6,457,268 | B1 | | 10/2002 | Perry et al. |

FOREIGN PATENT DOCUMENTS

| | | |
|---|---|---|
| CA | 2076019 | 4/1999 |

* cited by examiner

WEAR PLATE ASSEMBLY

RELATED APPLICATIONS

This is a continuation-in-part of application Ser. No. 09/971,540 filed on 10/09/2001, now abandoned.

FIELD OF THE INVENTION

This invention relates to the field of wear plate assemblies for loader buckets.

BACKGROUND OF THE INVENTION

In the mining and construction industries, loading and moving of heavy materials such as sand, gravel and rock is often accomplished using heavy machinery such as scoop trams, front-end loaders and powered bucket digging devices. During operation, these buckets tend to wear along their leading edges due to abrasion when entering the material pile and during contact with the ground. During use, the lip may tend to wear down, sometimes very quickly. After the lip wears down to a point where the base plate or bucket are threatened with wear, the bucket may typically be removed and sent to be refurbished by replacing the lip. Bucket removal is a relatively common practice in the mining industry at present. Rework and replacement of a bucket lip can be a major undertaking involving burning, cutting and welding. Time may be lost if the loader is transported to a shop where the bucket can be replaced. In a mining setting, the loader may remain inside the mine, the bucket being cut into two pieces and transported out of the mine to the surface. The replacement bucket may be returned in two pieces and be welded together before being placed on the loader. If a replacement bucket is not available or the replacement process is too cumbersome at the time, an operator may continue operating the loader nonetheless. As a result the base plate or the bucket itself may be damaged through overuse and may then require much more extensive repair than would otherwise be expected. The replacement of the base plate or bucket may well be much more costly than the use gained by operating the loader for the extra time.

Alternatively, the mine may keep an inventory of repaired buckets available. It is advantageous to reduce the ratio of buckets in inventory to the number of buckets in use, since buckets held in inventory, or being refurbished, are capital assets that are not earning revenue. Thus it is advantageous to make relatively simple replacement of wear plates and teeth in the mine, and to reduce the number of major overhauls requiring bucket removal to the surface.

When a loader or underground scoop tram is used for loading or transporting materials it is common to weld a base plate to the lower front edge of the bucket, the welding join line running from side to side across the bucket. The bucket is usually made of mild steel and the base plate is made of a mild steel or high carbon steel. The base plate is sometimes of greater thickness than the bucket plate. The upper surface of the base plate is installed flush with the inner surface of the bucket. The base plate has a lead, provided by leading edges that extend forwardly at an angle from the lower corners of the bucket to converge at a central point or tip. Different leads are selected by different operators to suit specific conditions. It is common for base plates to have leads of six, eight, ten or twelve inches, the lead being the distance that the tip is located forwardly of a line joining the outside corners of the bucket. A number of known scoop tram buckets have widths in the range of 56 to 112 inches, the tangent of the angle of the lead, viewed from above, being the lead dimension divided by the half width of the bucket.

Although the base plate can be more abrasion resistant than the material of the bucket, it is common practice to protect the base plate from premature wear by mounting a replaceable sacrificial wear lip or wear edge on the leading edges of the base plate. Typically, these wear edges are cut to suit, and are welded or bolted in place. Although welding and cutting operations tend to require greater labour they have been historically preferred. Releasable mechanical fastener systems, by contrast, tend to be regarded with considerable scepticism in view of the high stresses in the lip area during operation. However, mechanical fastening, as opposed to welding, permits different casting alloys to be used for the wear segments, and may tend to reduce reliance on specific welding skills to produce good welds in high wear alloys, such as, for example, Manganese steels.

It would also be advantageous to supply, and to bolt on, lip and wing wear segments that may be replaced several times over the life of the bucket. Some relatively complicated mechanical adapter systems are known, such as the Hensley (t.m.) J-bolt Edge System. This system uses a cleat that is welded to the bucket base plate, and a J-shaped bolt that attaches to the cleat to tighten a removable wear segment in place. The tightening action of the bolt is fore-and-aft, as opposed to vertical. The base plate does not have vertical bores for bolts. It would be advantageous to use a through-hole, as opposed to welded cleats. Leaving aside the lifting lug, the adapter fitting in the J-Bolt design stands up into the flow of incoming material a distance that is greater than the thickness of the base plate of the bucket. It would be preferable to employ fittings with a lower profile that may tend less to stand in the way of incoming material. In some replaceable wear equipment, the wear segments are bolted to the base plate by a dual flange fitting. This may result in looseness and high bolt stresses. It would be advantageous to use a single flange attachment.

The supply of replaceable wear edge assemblies for these wear areas, namely the forward lip and adjacent wing leading edges of excavating or loader buckets is the subject of this application, as is a system of standardisation that includes initial installation of base plate and wing segments, followed by the supply and installation of the remaining removable, and replaceable, wing and lip wear segments.

It is usual to weld a base plate along the lower edge of the bucket and to attach a cast, wear resistant lip along the leading edges of the base plate, as well as wing wear segments at the lower comers of the bucket. Usually, the base plate is welded to the bucket and the lip is welded to the base plate. The lip is usually made from a material, often as a casting, that is more wear resistant than the material used in the base plate or the bucket generally. For heavy digging the base plate and lip wear segments usually have a tapered or convergent lead, i.e., their front edges converge forwardly from the lower comers of the bucket, in some cases to a pointed tip as noted above, having an appearance of a pointed spade.

Loader buckets currently come in a variety of sizes. The present supplies of lip wear components to meet the numerous different bucket leads involves producing and stocking a wide variety of wear segments. As a result, many different sizes of lips may be manufactured and stocked to meet demand. This may result in a need to maintain a relatively large inventory. Another option is to sell one size of lips that can be trimmed by the user to match the bucket size. The rework of permanently installed (i.e., welded) wear components is also a major undertaking involving burning, cutting and welding. In many cases the work must be done in a heavy-duty garage. The lost machine operating time, the extent of the rework and the extra stocking of components may tend to be very costly and inefficient.

Replaceable, welded, leading edge wear shroud kits have been used in the past, but, in addition to the cutting and welding requirement, have tended to include elements as much as 40 inches wide or more. Such a part may weigh three hundred pounds or more. In general, the greater the weight of the part, the more difficult it is to handle, whether by hand or by machine, whether in shipping, transferring from one form of transport to another, installation or removal.

Further, the mating faces of the parts may not be planar, and may not be aligned with the forward and rearward direction of the bucket. Where the mating interfaces are arcuate or splayed, it may not necessarily be possible to remove each part without first removing another neighbouring part. The other part may not require replacement. This may complicate the occasional replacement of a single broken part, and may make general replacement of wear segments more time consuming than it need be. It would be advantageous to tend to avoid this complication by making the sides of adjoining segments straight and parallel, and preferably running in the fore-and-aft direction, to permit a segment to be slid into place between its neighbours. Although larger segments can be used, it would be advantageous to employ segments that are not more than 24 inches wide, and preferably not more than 20 inches wide. Similarly, it would be advantageous to keep the weight of each wear segment, or as many of them as practicable, below about 250 lbs., and preferably below about 200 lbs. It would also be preferable to be able to remove one segment without having to remove others first. That is, it would be advantageous to employ wear segments that do not require a specific order of removal and installation.

It would be advantageous, to adopt a wear plate system involving relatively few components, and relatively simple installation such as may be made in place with only minor lifting devices and bolting tools.

The effectiveness of a loader is determined by the number of loads per hour that can be loaded for a given material. Currently, lips for attachment to base plates have wedge shaped or rectangular profiles. These profiles may not be conducive to easy rolling of muck or other materials into the bucket. As a result, the effectiveness of the loader is reduced as muck gets caught on the lip or is slow to roll off the lip into the bucket. It may be advantageous to have a lip profile that may tend to encourage rolling motion in the muck. It may also be advantageous to have a lip profile in which the tip lies near or at the plane of the lower surface of the base plate.

It would be advantageous to have a lip that is mechanically attachable to, and removable from, the base plate relatively quickly and relatively easily, that is, without cutting, grinding or welding. It would be advantageous not to have to trim a cast or forged part to size for installation. It would also be advantageous if the shape of the lip were designed to encourage a rolling action in the material to be loaded. It would also be advantageous to use a method for providing lips which reduces inventory variety and inventory costs while still supporting a wide variety of bucket widths.

Accordingly, there is a need for a new lip design and a new method for providing such lips.

SUMMARY OF THE INVENTION

In one aspect of the invention, there is a set of wear segments developed to incorporate advantages over a number of existing systems. The wear sections are bolted in place and are sized for relatively easy handling and bolt-on installation. In a method aspect of the present invention this may tend to permit replacement in place at the worksite location, preferably without the use of welding, heavy machinery or the bodily removal of a bucket.

In another aspect or feature of the invention, there is a single flange, bolted lip-to-base-plate connection that may tend to reduce or eliminate lip movement relative to the base plate during operation. This may tend to reduce bolt shear stresses as compared to the dual flange arrangement mentioned above. In a further aspect or feature of the invention, the base plate has a sloped or chamfered section that extends rearwardly and downwardly from the flat abutment of the forward edge the base plate to its base-side, or surface. This chamfer may tend to permit a thicker wear lip section in the critical area.

In another aspect or feature of the invention, the wear segments have a wedge shape that may tend to promote relatively even top and bottom wear and may tend to reduce friction when penetrating a pile of loose material. The wedge shape may tend to present a reduced impediment to material flowing into, or out of, the bucket due to a thinner top section flange at the base plate connection. In a further feature of that aspect of the invention, the lip has a top curved profile that may tend to induce material entering the bucket to roll upwards and away from the bucket, possibly resulting in a relative reduction in friction between the material and the steel of the wear segment.

In another aspect or feature of the invention, standardisation of lip wear components to a limited number of sizes as required to meet a plurality of bucket sizes, may tend to reduce inventory stocking difficulties. In another feature of that aspect of the invention, there is a relatively small number of sizes of wear segments from which a selection of combinations and permutations will permit kits to be assembled to fit a relatively large number of bucket sizes. In an additional feature, wear segments of differing thicknesses are provided to suit differing thicknesses of base plates as chosen by operators according to bucket capacity and operating conditions. In another feature of the present invention, the bolt-on segments may tend to be relatively more easily installed in place without the use of heavy equipment, cutting or welding machines.

In another aspect or feature of the invention, there is a method in which there is a first modification of a standard bucket that involves the cutting away of existing bucket base plate protrusions, and the welding on of machined base plate wing sections. (The forward location of the base plate apex from the lower pivot pin is dictated by the original manufacturer's equipment specifications). According to a feature thereof, initial modifications are made that involve cutting and welding such as may tend to be of a permanent nature and such that the bucket should not tend to require further rework of a permanent nature for the duration of the life of the bucket.

In another aspect or feature of the invention there is a loader bucket assembly. It has a loader bucket having a backshell and a pair of opposed end walls mounted thereto. The backshell and end walls define a bucket cavity having a width. The backshell has a lower portion. The end walls are spaced from each other a distance defining a width of the loader bucket. A base plate is mounted to the lower portion of the backshell. The base plate has a width extending across the width of the loader bucket. The base plate has a leading edge, a first surface oriented inwardly relative to the backshell and a second surface oriented outwardly relative to the backshell. The base plate has bores defined therethrough. The bores are inset from the leading edge. At least one wear segment is mounted to the base plate. The wear segment has a leading edge oriented forwardly away from the base plate. The wear segment has a trailing portion having an accommodation for the leading edge of the base plate. The leading edge of the base plate has a male profile. The accommodation of the wear segment has a female profile matching the male profile of the leading edge of the base plate. The female profile includes a first portion engaging the first surface of the base plate and a second portion engaging the second surface of the wear plate. The wear segment has at least one bore formed therein. The bore of the wear segment and a corresponding one of the bores of the base plate are aligned when the male and female profiles are engaged. The wear segment and the base plate are connected at the aligned bores by an impermanent mechanical fastener in single shear.

In an additional feature of that aspect of the invention, the trailing portion of the wear segment includes first and second spaced apart flanges and a root section from which the flanges extend rearwardly, the flanges and the root co-operating to define the accommodation. In another additional feature, when the loader bucket rests with the base plate adjacent a ground surface, the first flange is an upper flange and the second flange is a lower flange. The lower flange extends further rearwardly than the upper flange. The bores of the wear segment are formed in the lower flange. The upper flange has tool access accommodations formed therein adjacent the bores of the lower flange. In yet another additional feature, the bores of the lower flange has centerlines lying in a plane, and the upper flange has a rearward edge lying abreast of the plane of the centerlines. In still yet another additional feature, the bores of the lower flange are countersunk to accommodate a locknut.

In a further additional feature, the bores of the base plate are countersunk to accommodate a tapered countersunk head of a threaded fastener. In still a further additional feature, the male profile has a chamfer, and the female profile has a matching chamfer. In yet a further additional feature, the assembly includes a plurality of the segments having a combined width corresponding to the width of the base plate.

In an additional feature, the base plate has a central point and left and right hand leading edges trailing rearwardly and outwardly from the point. The assembly includes a plurality of the wear segments, half of the segments being left handed, and half of the segments being right handed. In another additional feature, when the bucket assembly is resting with the base plate on a ground surface, the first surface of the base plate is an upper surface, and the leading edge of the wear member includes a tip having an abutment intersecting the plane of the second surface of the base plate.

In yet another additional feature, all of the bores in the base plate are on a uniform setback distance from the leading edge. In still yet another additional feature, the wear segment includes an upper surface extending rearwardly from the tip of the wear segment, and the upper surface is scalloped to encourage rolling action in the work material. In a further additional feature, the bucket has a width in the range of 58 to 112 inches, and the leading edge of the base plate are chosen from an inventory of segments consisting of segments of less than 24 inches in width.

In still a further additional feature, the bucket has a width in the range of 58 to 112 inches, and the wear segments for the base plate are chosen from an inventory of wear segments including wear segments of at least two widths. In yet a further additional feature, at least two widths are chosen from an inventory of wear segments of up to four widths selected from the set of widths consisting of (a) about 14½ inches; (b) about 16 inches; (c) about 18 inches; and (d) about 20 inches. In an additional feature, the wear segment has at least two of the bores formed therein, and the wear segment is connected to the base plate by at least two of the impermanent mechanical fasteners.

In another additional feature, the impermanent mechanical fasteners are threaded fasteners. In yet another additional feature, at least two bores are spaced apart and stand at a common setback distance relative to the leading edge of the base plate. In still yet another additional feature, the wear segment has a pair of side faces, the side faces lying in parallel vertical planes, the vertical planes being oriented in a fore-and-aft direction relative to the width of the bucket.

In a further additional feature, the base plate has a central lead point and left and right hand leading edges tapered sideways outwardly and rearwardly. A plurality of left handed wear segments is mounted side-by-side along the left hand leading edge. A plurality of right hand wear segments is mounted side-by-side along the right hand leading edge. At least one of the left hand wear segments has a leading abutment tip running parallel to the left hand leading edge and a pair of parallel side faces extending in a fore-and-aft orientation relative to the width of the bucket.

In another aspect or feature of the invention, there is the combination of a base plate and replaceable wear segments for a loader bucket having a width. The base plate has a trailing portion for permanent attachment to a lower portion of the loader bucket, and a leading portion extending forwardly thereof, and a width corresponding to the width of the bucket. The leading portion has a leading edge having a male profile. The base plate has a first surface and a second surface, the first and second surfaces being on opposite sides of the plate and lying in first and second parallel planes. The first surface of the base plate being for orientation inwardly relative to the bucket. The plate has a plurality of bore holes formed therein. The bore holes extend through the plate. The bore holes are set back from the leading edge. The wear segments have a combined width corresponding to the width of the bucket. Each segment has a first flange for engaging the first surface of the base plate, and a second flange for engaging the second surface of the base plate. The first and second flanges are joined at a common root portion of the segment. The flanges and the root portion define between them a rearwardly facing socket. The socket has a female profile matingly engageable with the male profile of the leading edge of the base plate. Each wear segment has a pointed leading portion for engaging material to be carried in the loader bucket, the leading portion extending forwardly of the socket. The second flange has at least one bore hole formed therein for alignment with a corresponding one of the bore holes of the base plate. The bore hole of the wear segment is aligned with the corresponding bore hole of the base plate when the male and female profiles are engaged. The base plate and the wear segment are securable by a mechanical fastener mounted through the bores across a single connection interface.

In an additional feature, the male profile of the base plate includes a chamfered edge, and the female profile has a mating chamfer. In another additional feature, the base plate has a first through thickness, and the first flange has a second through thickness, the second through thickness being less than the first through thickness. In yet another additional feature, the base plate has a first through thickness, and the second flange has a second through thickness, the second through thickness being greater than the first through thickness.

In still yet another additional feature, the bores in the base plate are countersunk from the first surface to admit a fastener having a countersunk head lying in a position chosen from the set of positions consisting of (a) flush with; and (b) shy of, the first surface of the base plate. In a further additional feature, the first flange has tool access reliefs formed therein, the reliefs being located in positions corresponding to the bores of the second flange. Alternatively, the fastener may comprise a square head bolt in which the head is inserted into a square recess in the wear segment (described below) to prevent rotation of the bolt. The head is on the lower surface, with a washer and nut being fastened to the upper portion of the bolt. Positioning of the nut on the upper surface provides a convenient visual check to ensure the nut has not fallen off during use.

In still a further additional feature, the leading portion of the segment has first and second diverging flanks extending rearwardly of the tip thereof. The first flank extends from the tip toward the first flange. The second flank extends from the tip toward the second flange. The first flank has a surface having a convex profile relative to the second flank.

In yet a further additional feature, the leading portion of the segment includes an abutment face. The abutment face and the first flank meet along a vertex. The vertex lies between the first and second planes. The vertex lies closer to the second plane than to the first plane. In an additional feature, the leading portion includes an abutment face. The abutment face and the first flank meet at a first vertex. The abutment face and the second flank meet along a second vertex. The first vertex lies to one side of the second plane, and the second vertex lies to the other side of the second plane.

In another additional feature, the assembly includes wear segment attachment fittings for mounting to the vertical edges of side walls of the bucket, and shrouds for mounting to the wear segment attachment fitting. The shrouds each include a pair of rearwardly extending parallel flanges and a rearwardly facing slot defined therebetween. The attachment fittings each include a forwardly facing web. The web and the slot being matable. The web and one of the flanges has corresponding bores formed therein to admit a fastener to connect each shroud to a respective side wear segment attachment fitting across a single connection interface.

In another aspect or feature of the invention, there is a replaceable wear segment for impermanent mating with a leading edge of a permanently affixed base plate of a loader bucket assembly. The base plate has bore holes formed therethrough adjacent to the leading edge. The wear segment has a body has a leading portion and a trailing portion. The leading portion has a leading edge for advancing into a pile of material to be loaded into the loader bucket. The trailing portion has a pair of first and second spaced apart flanges, the flanges having proximal ends joined at a root, and distal ends extending rearwardly thereof. The first and second flanges have respective opposed faces lying in respective first and second spaced apart parallel planes. The opposed faces and the roof co-operate to define a rearwardly facing socket. The socket has a profile to match the leading edge of the base plate. The second flange has a bore hole defined therein to admit an impermanent mechanical fastener to be inserted therethrough, and through a bore of the base plate for impermanent single shear connection of the wear segment to the base plate.

In an additional feature, the segment is a casting. In another additional feature, the trailing portion of the wear segment includes first and second spaced apart flanges and a root section from which the flanges extend rearwardly, the flanges and the root cooperating to define the accommodation. In yet another additional feature, when the first flange rests on a ground surface, the first flange is an upper flange and the second flange is a lower flange. The lower flange extends further rearwardly than the upper flange. The bores of the wear segment are formed in the lower flange. The upper flange has tool access accommodations formed therein adjacent the bores of the lower flange.

In still yet another additional feature, the bores of the lower flange have centerlines lying in a plane, and the upper flange has a rearward edge lying abreast of the plane of the centerlines. In a further additional feature, the bores of the lower flange are countersunk to accommodate a locknut. In still a further additional feature, the accommodation has a chamfered surface at the root. In yet a further additional feature, the leading edge of the wear member includes a tip having an abutment intersecting the plane of the second surface.

In an additional feature, the wear segment includes an upper surface extending rearwardly from the tip of the wear segment, and the upper surface is scalloped to encourage rolling action in the work material. In another additional feature, the wear segment has at least two of the bores formed therein. In yet another additional feature, at least two bores are spaced apart and stand at a common setback distance relative to the leading edge of the base plate. In still yet another additional feature, the accommodation has a first through thickness measured between the first and second parallel planes, and the first flange has a second through thickness, the second through thickness being less than the first through thickness.

In a further additional feature, the accommodation has a first through thickness measured between the first and second parallel surfaces, and the second flange has a second through thickness, the second through thickness being greater than the first through thickness. In still a further additional feature, the first flange has tool access reliefs formed therein, the reliefs being located in positions corresponding to the bores of the second flange. In yet a further additional feature, the leading portion of the segment has first and second diverging flanks extending rearwardly of the tip thereof. The first flank extends from the tip toward the first flange. The second flank extends from the tip toward the second flange. The first flank has a surface having a convex profile relative to the second flank.

In an additional feature, the leading portion of the segment includes an abutment face. The abutment face and the first flank meet along a vertex; the vertex lies between the first and second planes. The vertex lies closer to the second plane than to the first plane. In another additional feature, the leading portion includes an abutment face. The abutment face and the first flank meet at a first vertex. The abutment face and the second flank meet along a second vertex. The first vertex lies to one side of the second plane, and the second vertex lies to the other side of the plane.

BRIEF DESCRIPTION OF THE DRAWINGS

For a better understanding of the present invention and to show more clearly how it may be carried into effect, reference will now be made by way of example to the accompanying drawings, which show an assembly according to the preferred embodiment of the present invention and in which.

DETAILED DESCRIPTION OF THE ILLUSTRATIVE EMBODIMENT

Figure 1:
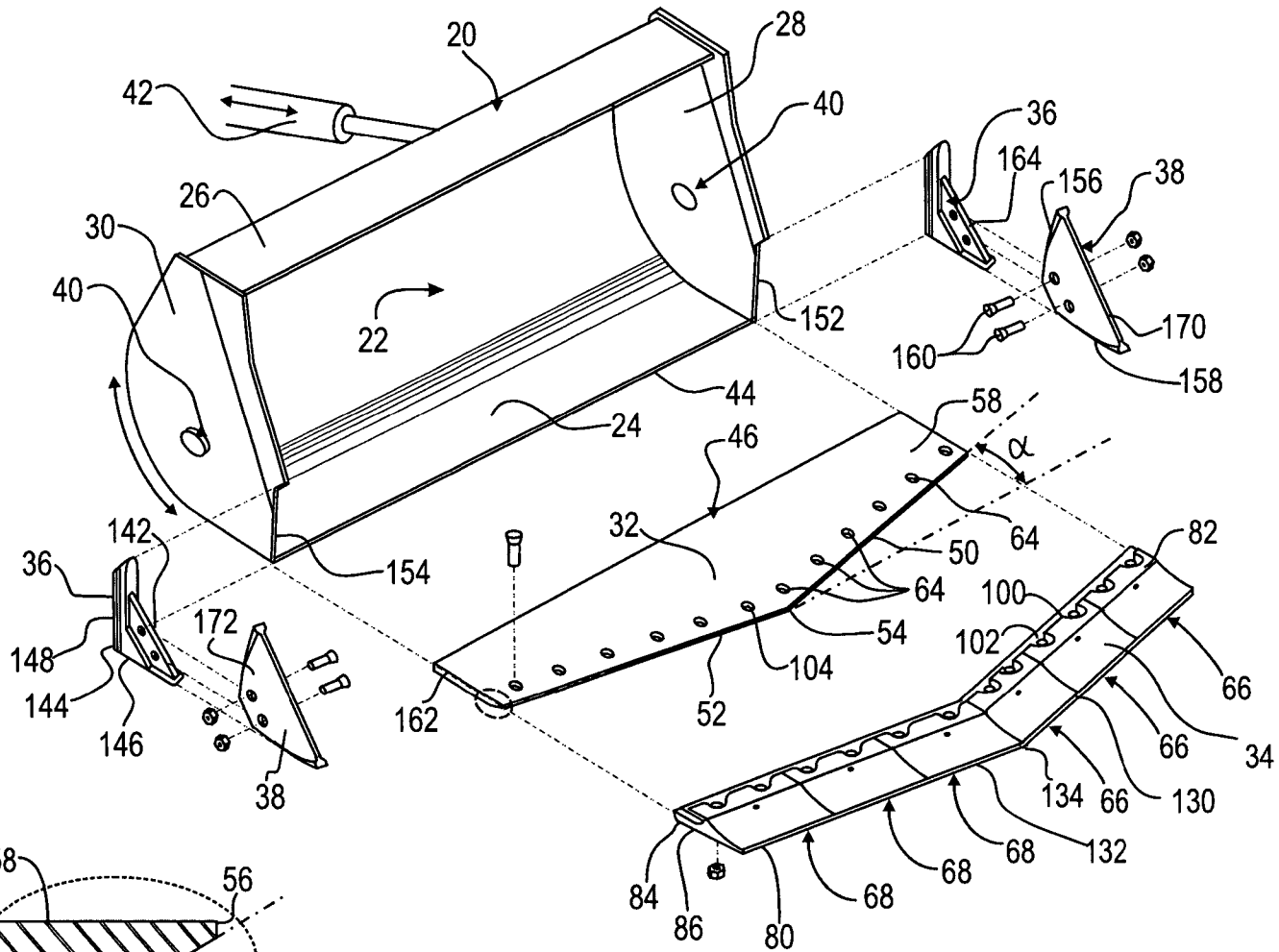
FIG. 1 is an exploded perspective view of a front end loader bucket having a base plate having lip wear segments bolted to its leading edges.

The description that follows, and the embodiments described therein, are provided by way of examples of particular embodiments of the principles of the present invention. These examples are provided for the purposes of illustration, and not of limitation, of those principles and of the invention. In the description that follows, like parts are marked throughout the specification and drawings with the same respective reference numerals. The drawings are not necessarily to scale and in some instances proportions may have been exaggerated in order more clearly to depict certain features of the invention. In this description the terms "leading" or "forward" refer to the direction of advance of the equipment into a work substance, be it earth, or gravel, or rock, or some other substance.

By way of general overview, FIG. 1 shows an exploded view of a bucket 20 of a front end loader (not shown) having wear components for installation thereon. Bucket 20 has a backshell assembly 22 in the form of a generally rectangular plate formed on a curve of constant radius, terminating in a leading, or lower tangential plate portion 24 that forms the base wall of bucket 20, and another planar portion 26 that forms the upper edge of bucket 20. The curved backshell assembly 22 is bounded at either end by left and right end walls 28, 30. End walls 28 and backshell assembly 22 co-operate to define the scoop area of bucket 20.

Bucket 20 has wear components for installation along the leading portions, or leading edges, of lower tangential plate portion 24 and end walls 28, 30. The wear components include a base plate 32 for mounting to tangential plate 24; an array, or set, of lip shrouds, indicated as lip wear segments 34, for mounting to base plate 32; wing attachments 36 for mounting to end walls 28, 30; and corner shrouds indicated as wing wear segments 38 for mounting to wing attachments 36. Each of these components is described in greater detail below.

Bucket 20, when installed on a tram scoop (not shown) or front end loader (not shown), is raised or lowered by means of an external mechanism, such as a boom assembly (not shown) which carries the weight of bucket 20 through pivot assemblies mounted at the main pivot points, indicated as 40. Bucket 20 can be rotated about these points through some angular range of motion. Typically, the angular orientation of bucket 20 relative to the booms upon which it is mounted is controlled by means of one or more hydraulic cylinders, exemplified by a centrally located powered cylinder in the nature of a hydraulic ram 42. Hydraulic ram 42 has one end connected to the boom assembly, and another end connected to a rearwardly oriented portion of the bucket exterior that is offset by a moment arm distance from pivot points 40 such that extension or retraction will tend to cause bucket 20 to pivot. In addition to the bucket mechanisms, translational forward and rearward motion of the front end loader to force the bucket into a pile of material when excavating or digging is provided by the front end loader's engine and drive train.

Base Plate

Figure 6:
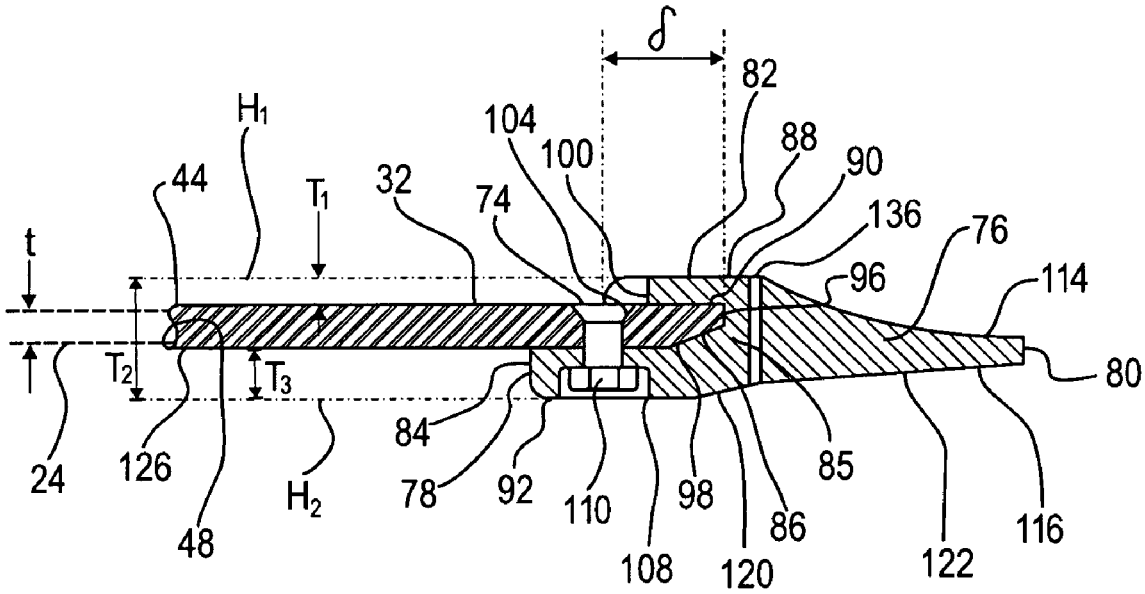
FIG. 6 is a sectional view through a front lip wear segment, the base plate and bucket base connecting plate taken along section 6-6 of FIG. 3.
Figure 7:
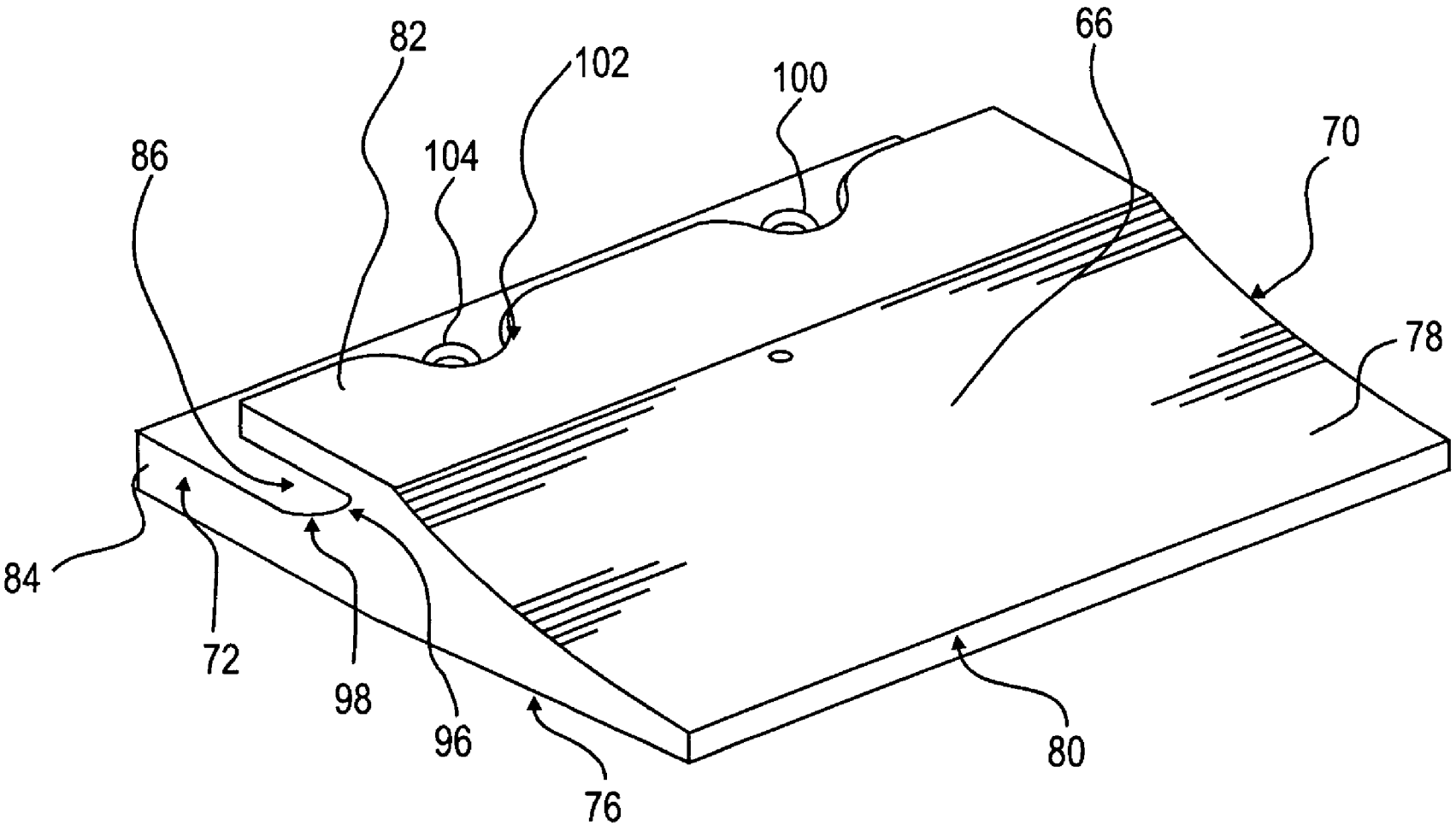
FIG. 7 is an isometric perspective view of a lip wear segment for the bucket of FIG. 1.
Figure 8:
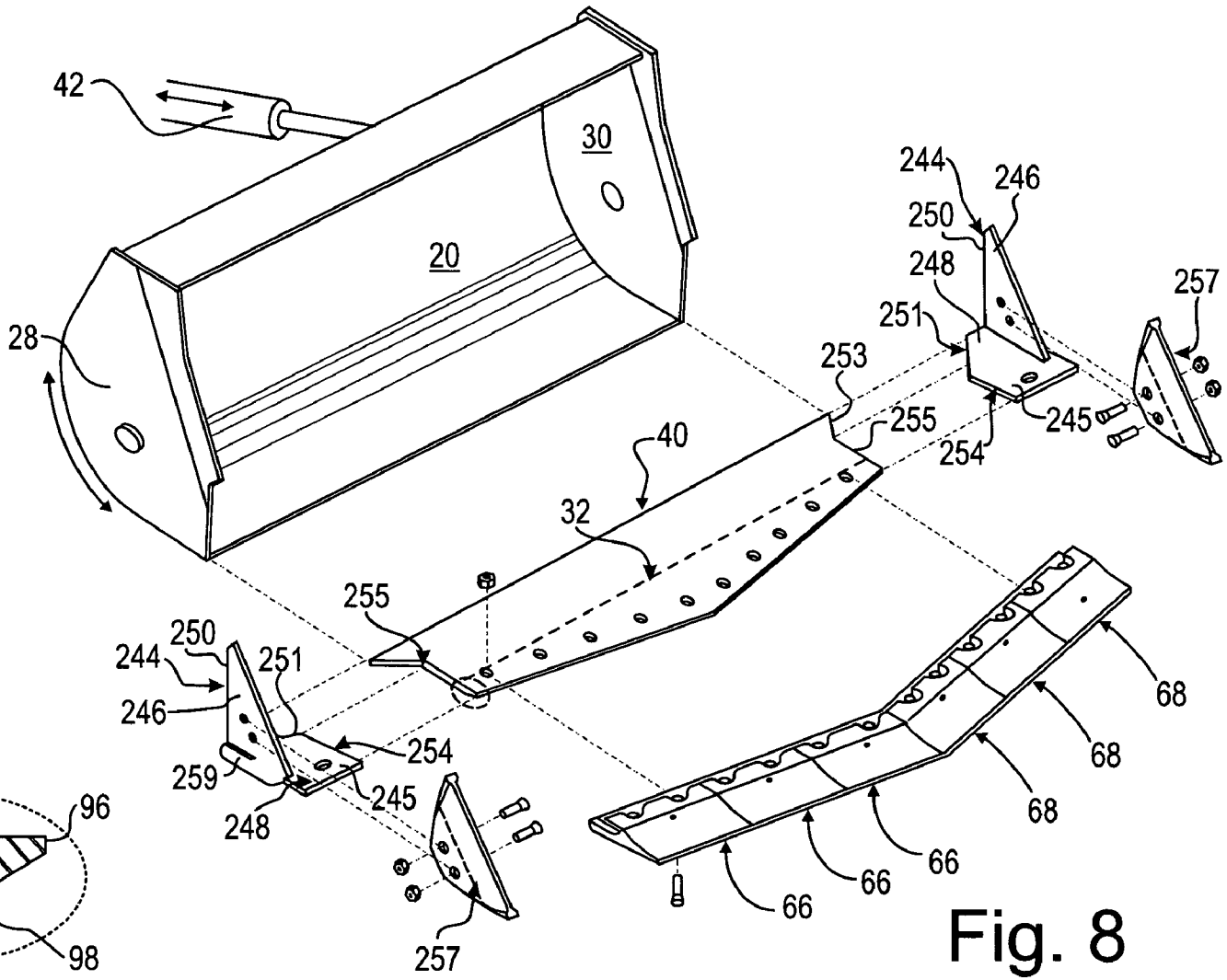
FIG. 8 is a perspective view of another embodiment, showing excavator bucket, lead, corner shroud unit and lip wear protector array, in an exploded view.
Figure 9:
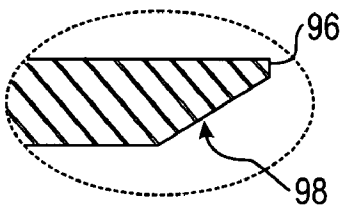
FIG. 9 is a side elevational view of the circled portion of the lead shown in FIG. 8.
Figure 10:
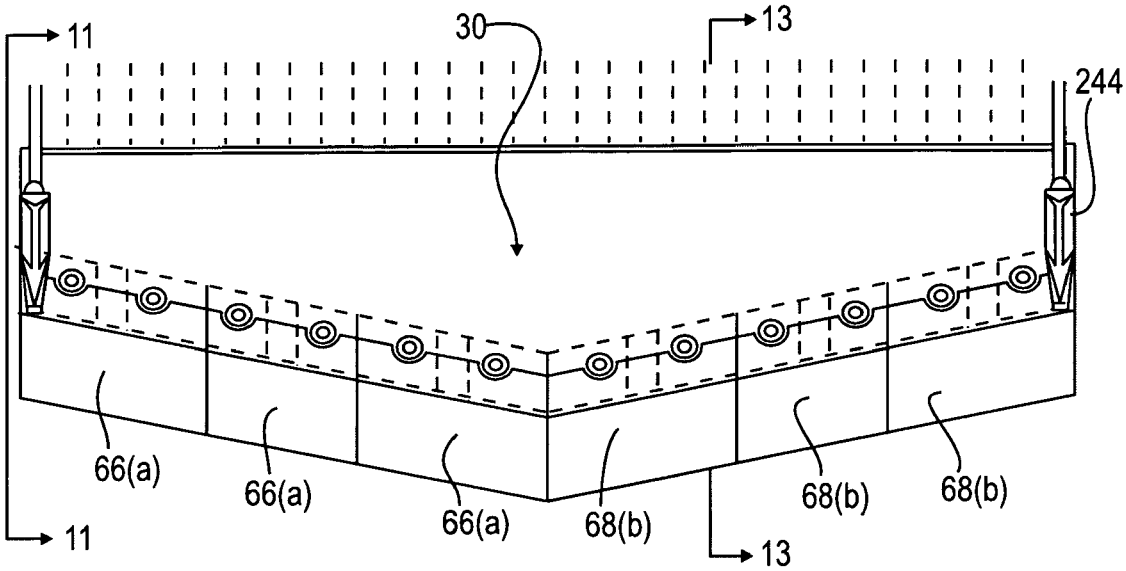
FIG. 10 is a plan view from above of an excavator bucket, lead and lip protector array, illustrating an alternative corner shroud assembly.
Figure 11:
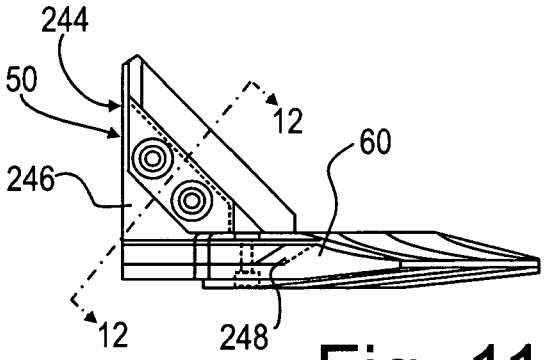
FIG. 11 is a side elevational view from the direction indicated as 11-11 in FIG. 10.
Figure 12:
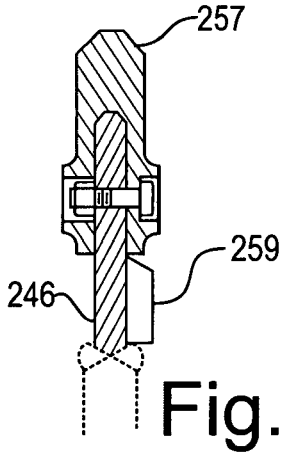
FIG. 12 is a sectional view along line 12-12 of FIG. 10.
Figure 13:
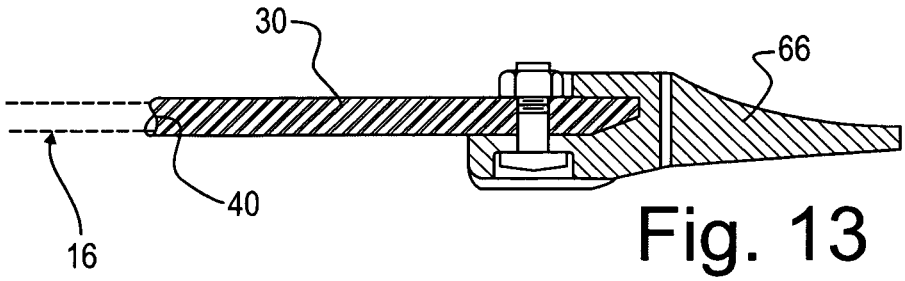
FIG. 13 is a sectional view along line 13-13 of FIG. 10.

Base plate 32 is affixed to a front edge 44 of lower plate portion 24 of bucket 20 by welding or other rigid mounting means. A rear edge 46 of base plate 32 runs parallel to the lower edge of lower plate portion 24 of bucket 20 and is pre-machined with a chamfer 48 as shown on FIG. 6. Chamfer 48 extends along the full length of base plate 32 and is used for the continuous bevel welded connection between bucket 20 and base plate 32. The weld runs along the front edge 44 of lower plate portion 24 and the rear edge of base plate 32 such that the upper surface of base plate 32 and the upper surface of the inside of bucket 20 lie flush with one another as shown in FIG. 6. Base plate 32 has a chevron shaped leading edge having two portions, indicated as left and right hand leading edges 50, 52 that extend forwardly and converge at a point, or tip, 54. That is, the leading edges 50, 52 of base plate 32 are each tapered rearwardly from the central point along a horizontal rake angle, indicated as $\alpha$, being the lead angle of the bucket assembly generally. In one embodiment $\alpha$ is about 12 degrees.

Figure 2:
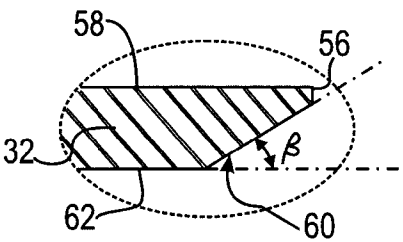
FIG. 2 is an enlarged side corner view of a base plate of the loader bucket of FIG. 1.

As shown in the sectional view of FIG. 2, leading edges 50, 52 are machined to have a flat, vertical planar surface portion indicated as 56 adjoining the horizontally planar upper surface 58, and a chamfered planar surface portion indicated as 60 running from a vertex at portion 56 to meet lower horizontally planar surface 62 on a chamfer angle indicated as $\beta$. In one embodiment $\beta$ is about 20 degrees measured from the horizontal. The vertical portion 56 is a machined vertical face sometimes referred to as the abutment, or abutment edge.

Base plate 32 also has an array of tooth engagement interface fittings in the nature of through-bores, or apertures, identified as bolt holes 64. Bolt holes 64 have a uniform center set back distance relative to leading edges 50, 52, the setback distance being identified as δ. In one embodiment this distance is about 4.17 inches. The thickness t of base plate 32 may vary depending on the size of bucket 20 or type of application. Thickness t may be 1½", or 1 11/16", or 2", 20. That is, base plate 32 has a width, indicated as "W" that permits it to be mounted to bucket 20. There may be several types of front end loader bucket for which a leading plate of width "W" can be used. "W" is typically in the range of 55 to 112 inches. A person seeking to order replaceable lip members, as described below, for a given type of loader bucket may tend to examine, for example, a catalogue of available plates 32, locate the type, or width, of bucket in question, and find the size of plate 32 suitable for that bucket. The catalogue may then indicate the number of lip members of stock sizes that are to be used with that plate, so that purchasers may select and buy them as a kit.

Wear Segments

The array of wear segments indicated in FIG. 1 as 34 includes left and right hand wear segments 66, 68. Inasmuch as wear segments 66 and 68 are left and right hand mirror images of each other, a description of the one will serve also to describe the other. When seen in plan view, left and right hand lip wear segments 66, 68 are parallelogram shaped, having a leading edge, or front abutment; a trailing edge, or rear abutment; and a pair of parallel side faces, 70, 72. The leading and trailing edges are generally parallel, and are skewed with respect to side faces 70, 72 at the same angle as the horizontal rake angle α(i.e., the lead angle) of leading edges 50, 52. As installed, in use the front and rear abutments run parallel to the base plate lead, and the sides run parallel to the bucket sides. Wear segments 66, 68 are bolted in place using high strength countersunk bolts 74, as noted below.

The body of each of wear segments 66, 68 has a leading portion, indicated generally as 76, and a trailing portion indicated generally as 78. Leading portion 76 is formed into a front abutment, or leading edge indicated as tip 80 such as may be advanced into a work material. Trailing portion 76 has a mounting fitting, or mounting interface, acting as a slot or socket by which it can be relatively rigidly, and removably, attached to the leading portion of plate 32. Lip wear segments 66, 68 may be made in various widths of cast, or forged steel, or hard wearing alloy steel as discussed below.

When seen in section as in FIG. 6, trailing portion 78 has a bifurcated pair of first and second legs 82 and 84 formed on either side of a fitting or accommodation for the base plate leading edge in the nature of a recess, or rabbet, or crotch, or slot, or socket, however it may be termed, indicated as a wear plate leading edge engagement slot, or groove 86. Legs 82 and 84 may also be referred to as spaced apart first and second, or upper and lower flanges of segment 66, 68. Groove 86 is formed to engage the tongue, that is to say the leading edge 50 (or 52, as the case may be), of base plate 32.

Legs 82 and 84 are unequal in length and in thickness. That is, upper leg 82 has an upper surface 88 lying in a first horizontal plane, $H_1$ defining the upper extent of the wear segment 66 or 68; and a parallel horizontally planar inwardly facing lower surface 90 that, when installed lies adjacent to and faces the leading margin of upper surface 58 of base plate 32. The thickness of upper leg 82 is indicated as $T_1$. Similarly, lower leg 84 has a horizontally planar lower surface 92 lying in a second horizontal plane $H_2$, downwardly offset from plane $H_1$ by a distance $T_2$. $T_2$ defines the overall through thickness of wear segment 66 (or 68, as may be). Lower leg 84 also has an inwardly facing, upwardly oriented horizontally parallel planar upper surface 94. The thickness of lower leg 84 is indicated as $T_3$, and the thickness of groove 86 is indicated as $T_4$, being the overall thickness $T_2$ less the thicknesses $T_1$ and $T_3$ of the two legs. $T_4$ corresponds to the thickness t of base plate 32, plus a tolerance to permit the two parts, namely the leading edge of base plate 32 and groove 86 of wear segment 66 (or 68) to be engaged in a mating manner by advancing, that is, sliding, the male part, namely the leading edge of base plate 32 into the female part, namely groove 86. In one embodiment $T_1$ is about 0.91 inches; $T_2$ is about 4.45 inches; $T_3$ is about 2.00 inches; $T_4$ is about 1.54 inches.

The root, or groin region 85, of the body of segment 66, is located adjacent the innermost portion of groove 86, and joins the proximal ends of legs 82 and 84. The rearwardly facing abutment at the root is defined by a first vertically planar, end wall portion 96, adjoining, and extending perpendicular to, the innermost margin of inwardly facing lower surface 90 of upper leg 82, and a second, sloped planar surface portion 98 extending between first end wall portion 96 and the innermost margin of inwardly facing upper surface 94 of lower leg 84, sloped portion 98 lying on an angle corresponding to angle β of chamfered portion 60 of base plate 32. The conforming profiles of groove 86 and the chamfered leading edge of base plate 32 are intended to mate to a relatively high level of precision.

Upper leg 82 has rearwardly opening tool access recesses, or reliefs in the nature of scallop shaped bolt allowances 100, 102. In the embodiment illustrated, each wear plate has two such allowances spaced apart, although a different number could be used. Lower leg 84 has correspondingly placed fittings in the nature of countersunk bores, namely bolt holes 104 by which releasable mechanical fasteners such as threaded fasteners in the nature of bolts 74 can fasten wear plate 66, or 68, to base plate 32 when bores 64 are aligned with bores such as bolt holes 104. This condition occurs when the leading edge of base plate 32 is mated snug within groove 86. Although a single bolt can be employed, it is advantageous that two or more bolts be used, since this will tend to discourage the wear segment from working due to any urge to pivot about a single bolt fitting, such as might, repetitively, cause the bolts to loosen or fail more easily over time.

The square shouldered countersink 108 is formed on the underside of lower leg 84 to give a recess for the nut in a position that may be less exposed to wear than otherwise. The recess so formed is of sufficient diameter to admit a manual or powered socket wrench for engaging nut 110. Bolt allowances 100, 102 similarly provide space for a manual or power driven tool head to engage the countersunk head of bolt 74 during installation and removal as it seats in the mating counter sink of bolt hole 64. The trailing edge of upper leg 82 terminates roughly flush with, or somewhat rearwardly of, the vertical plane of the centreline of the bolt holes 104. When installed, bolt 74 is in single shear relative to loads in the horizontal direction, and, being tightened to a set torque, the interface area of the mating parts adjacent the bolted connection is in compression. The tight fitting single planer interface connection may have less tendency to develop 'play' than a double shear connection that, for example, may tend to squeeze a pair of opposed flanges together. The horizontal loads are intended to be transferred across the end wall abutment interface, rather than through shear in the bolts.

Upper leg 82 is relatively thin, being of lesser thickness than either base plate 32 (or groove 86), to encourage easier loading and unloading of bucket 20 generally. Lower leg 84 is relatively thick, being thicker than not only upper leg 82, but also groove 86, and base plate 32, to provide a measure of wear when the leading portion of bucket 20 is advanced in a sliding orientation along the ground or other surface, and into a pile of material to be moved.

Leading portion 76 has an upper flank in the nature of a surface 114 and a lower flank in the nature of a lower surface 116, the upper and lower surfaces 114 and 116 converging forwardly toward narrow tip 80. (Alternatively said, the upper and lower flanks diverge rearwardly from tip 80 to the upper and lower flanges, namely legs 82 and 84 respectively). Upper surface 114 is formed on an arc that runs from a vertex at the intersection of surface 114 with the plane of upper surface 88 to another vertex at the intersection of surface 114 with the thin vertical face of tip 80. The arc is concave upward. That is, the center of curvature of the arc, or portions thereof, stands above leading portion 70. In one example, the center of curvature lies in the vertical plane of tip 80. The radius of curvature of the arc of surface 114 is advantageously in the range of 15" to 30", and is preferably about 20" to 21". In a preferred embodiment it is 20.47". This arcuate profile of surface 114 may tend to encourage material encountered as bucket 20 is driven forward to have a rolling motion as it accumulates. This rolling motion is considered desirable as it is thought to reduce the effort of loading bucket 20. The shape of the leading portion may also tend to promote self sharpening in operation.

Figure 3:
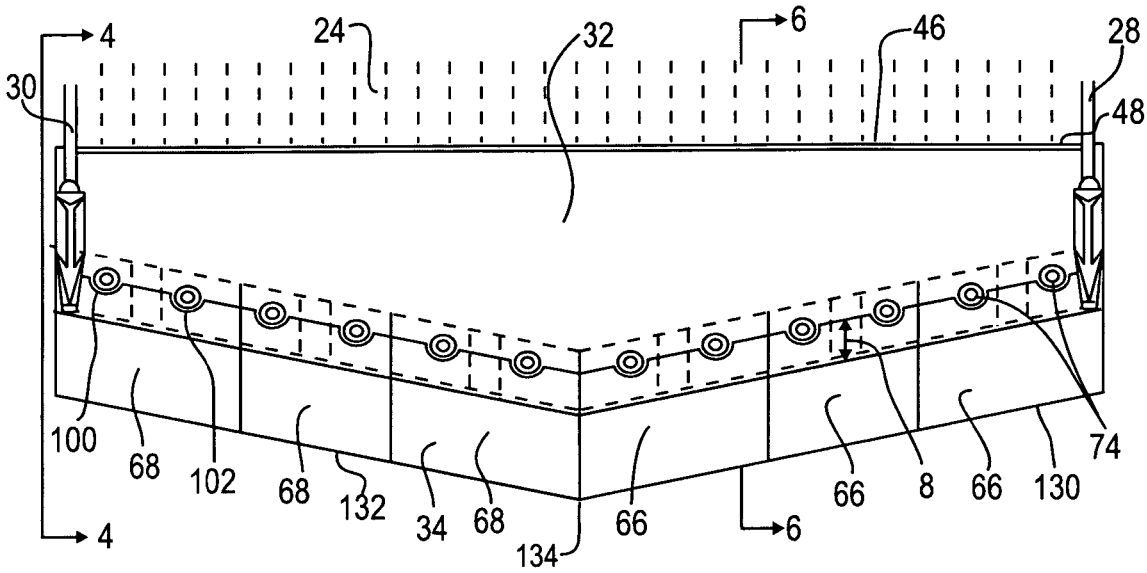
FIG. 3 is a plan view of the bucket front of FIG. 1 with the wear assembly components installed.
Figure 4:
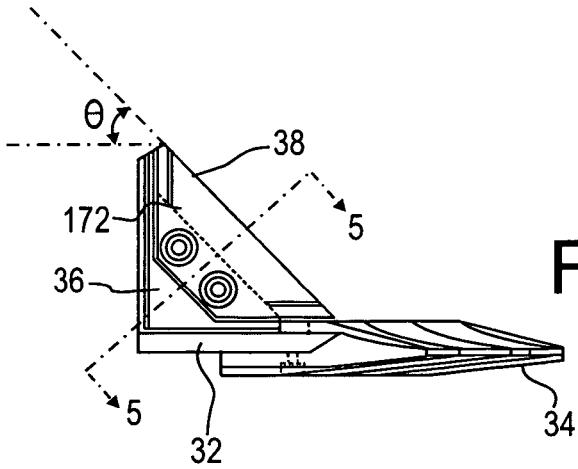
FIG. 4 is an end view of an installed wing plate and wing wear segment of the bucket of FIG. 1.

Lower surface 116 has a relatively short proximal planar surface portion 120 adjoining, and extending forwardly of lower surface 92 of lower leg 84. Lower surface 116 also has a relatively longer distal planar surface portion 122 extending forwardly from a juncture at the forward margin of portion 120 to meet tip 80 at a vertex along the lower edge of tip 80. Distal portion 122 is set at a shallower relief angle relative to the horizontal than proximal portion 120. The angled portion of segment 66 lying between proximal portion 120 and surface 98 is thicker than $T_3$, and increases linearly in thickness in the forward direction, being thinnest adjacent the rearward margin of proximal portion 120. The juncture of portions 120 and 122 lies abreast of the end of groove 86. That is, the juncture lies, roughly, level with the vertical plane of end wall portion 96, or somewhat forward thereof toward tip 80. Lower surface 92 of lower leg 84 extends to either side of bolt hole in the width direction of bucket 20 only part of the width of segment 66, 68 (indicated in phantom in FIG. 3) in the region of the bolt and nut to provide local protection for them. The region of the underside of segment 66, 68 away from the bolt hole is carried through on a flat surface parallel to the plane of surface 92, extending rearwardly from the line of intersection of distal portion 122 and proximal portion 120.

Restating this, the recess, namely groove 86, between the lower flange (lower leg 84) and the upper flange (upper leg 82) at the rear of lip wear segment 66 (or 68) is defined by a narrow flat front abutment, namely end wall portion 96; a horizontal plane in the nature of lower surface 90 on the underside of the upper flange, (that is, upper leg 82); a uniformly tapering plane, namely surface 98, that extends rearwardly and downwardly from the lower edge of the abutment; and a horizontal plane, namely plane 94 on the upper portion of the lower flange (that is, lower leg 84). The horizontal distance between the abutment and the centerline of bolt hole 104 is at least δ so that the recess, (groove 86) will fit about leading edges 50, 52 of base plate 32 and allow boltholes 64 and 104 to be aligned. The recess will then fit about the machined leading edges 50, 52 of base plate 32 as the sloping surface of chamfered portion 60 and the front vertical end face portion 56 meet the plane of planar surface 98 and the rear abutment, namely vertical end wall portion 96, respectively, when the lip wear segments 66, 68 are affixed to base plate 32. Preferably, any gaps between base plate 32 and the recess are minimized.

Left and right hand lip wear segments 66 and 68 may be arranged onto base plate 32 such that they present contiguous leading left and right hand edges 130 and 132, meeting at a point or tip 134 and such that bolt holes 64 are aligned with boltholes 104. Bolts 74 may then be passed through bolt holes 64 of base plate 32 and bolt holes 94 of lip wear segment 34 and closed with locknuts 110 to create a tight connection between base plate 32 and lip wear segment 34.

Each of wear segments 66, 68 has defined in it as a means of indicating the extent of wear and replacement time prior to damaging base plate 32. Wear-indicating hole 136 passes through the entire thickness of lip wear segment 66, 68 from upper surface 114 to lower surface 116. When lip wear segment 66, 68 has not been used, hole 136 can only be seen from above and below lip wear segment 34. If, after use and upon inspection of lip wear segments 34 it is apparent that some of the length of wear-indicating hole 120 can be seen from the front, lip wear segments 34 can be replaced to prevent damage to base plate 32.

Figure 5:
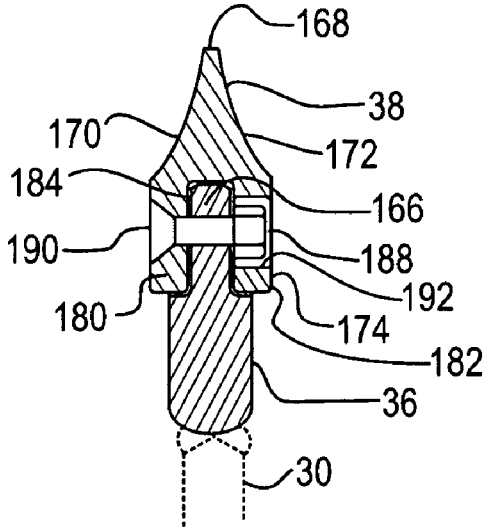
FIG. 5 is a sectional view of an installed wing and wing wear segment taken along section 5-5 of FIG. 4.

As shown in FIGS. 1 and 5, wing segments 38 are generally trapezoidal plates. Wing segments 38 have an inclined upper, or leading edge 142 and a parallel, though shorter, inclined lower or trailing edge 144 parallel to leading edge 142. The horizontal side of the trapezoid is indicated as a base or lower edge 146. The vertical side of the trapezoid is indicated as a rearward edge 148. Leading edge 142 and trailing edge 144 are angled away from the vertical at an angle θ.

Inasmuch as base plate 32 serves as intermediary adapter fittings for mounting segments 66 and 68 to bucket 20 more generally, so also wing attachments 36 serve as intermediaries, or adapter fittings for mounting of wing wear segments 38 to the vertically extending lower portions of the leading edges, or margins 152, 154, of end walls 28 and 30 of bucket 20 more generally. To that end wing wear segments 38 are cut plates that each have a vertical side 156 welded to margin 152 or 154 of end walls 28 and 30, and a horizontal side 158 welded to the side margins, or edges 160, 162 of base plate 32. Each plate has a generally triangular portion having a hypotenuse that is inclined rearwardly and upwardly at an angle corresponding to the angle of inclination of the wing wear segments, 38, namely angle θ. Each of wing attachments 36 also has a thinned web portion 164 running inwardly from the inclines edge of the hypotenuse to give a trapezoidally shaped land on either side, leaving a tongue in the form of a thinned leading edge 166.

Wear segment 36 has a leading edge 166 having a narrow front abutment in the nature of a tip 168 along most of its length and hollowed or scalloped arcuate surfaces 170, 172 extending rearwardly from either side thereof. The trailing portion 174 of wing segment 38 has two parallel flanges, identified as first and second, inboard and outboard legs 180 and 182 with a slot or recess, identified as socket 184 defined, therebetween. Socket 184 is similar in nature to groove 68. Recess 184 is shaped to fit snugly about the thinned section, namely web portion 166 of wing attachment 38. Flange, or inboard leg 180 has a tapered countersink 188 to accommodate the countersunk head of a bolt 190 to be engaged therein. Flange, or outboard leg 182 has a clearance bore 192. Bore 192 is not recessed like countersunk 96, but passes completely though outboard leg 182. As installed, wing segment 38 is aligned over plate 36 such that bolt 150 may be passed through the step, that is, through thinned leading edge 166 in the inner flange, leg 180, and bolt hole 190 in plate 36. A locknut 194 is threaded onto bolt 190 and tightened to lie in bore 192 abutting the outside face of the thinned section 166 of plate 36. All of locknut 194 lies shy of the outside face of the outer flange, tending to obtain some protection from wear thereby. Thus flange 180 and plate 36 may be brought together in a tight connection similar to that of segments 66, 68 with base plate 32.

Alternatively, the bolt 190 may be oriented with the head downwardly and the nut facing upwardly to provide visual confirmation that the nut 194 is properly in place. A washer, not shown, may be placed beneath the nut. The bolt head is conveniently square and set into a square recess to prevent rotation.

Sizes and Kits

As there are a variety of sizes of buckets, different sizes of lip wear segments are required. There are over two dozen standard widths of loader buckets in use in industry today. It has been determined that four different standard widths of lip wear segments 66, 68 (20 inch, 18 inch, 16 inch and 14.5 inch) can be variously combined to yield rear plate sets or kits suitable for use with at least 25 different standard size loader buckets. The use of a few standard lip wear segment sizes will reduce manufacturing costs, shipping costs and inventory costs as well as serve a wide variety of bucket sizes. Other size combinations are also possible.

In use, base plate 32 is welded onto bucket 20 along base plate rear edge 46. Base plate 32 is selected to have a width equal to that of bucket 20. For the given width of base plate 32, a combination of standard lip wear segments 34 of left and right hand orientations is obtained. The total width of lip wear segments 34 is equal to the total width of base plate 32. Similarly, wing attachment adapter fittings, 36 are welded in place.

Either before or after base plate 32 is welded onto bucket 20, base plate 32 is drilled with boltholes 64 to align with boltholes 94 of lip wear segments 34. As well, leading edges 50, 52 of base plate 32 may be machined to form a wedge type abutment as described to fit snugly within recess 100 of lip wear segment 66, 68.

After base plate 32 is mounted to bucket 20, wing attachments 36 are welded to bucket 20 and base plate 32 along edges 130 and 132. Segment 38 is then bolted to wing attachment fitting, 36. After wing segments 38 are attached, lip wear segments 66, 68 are bolted onto base plate 32.

In operation, the loader forces bucket 20 into a material pile such as earth or ore and lifts bucket 20 upwards. The material rolls along lip wear segment 34 and base plate 32 into bucket 20. The curvature in lip wear segment 34 may tend to allow the material to roll into bucket 20 at an increased rate allowing for more loads per hour. As well, some material that contacts wing wear segment 38 will enter bucket 20. Again, the curvature of wing wear segment 38 allows for more efficient rolling motion of the material.

Wear plate segments 66, 68 and 38 are subject to wear during use. After some time an operator or maintenance technician, may observe that the witness marks, namely wear indicating holes 136, may have worn to such an extent that insufficient material is left for further use.

It can be seen from the geometry of FIG. 6 that the upper edge of tip 80—that is, the vertex formed at the intersection of the arcuate surface 114 and the vertical end surface of tip 80, lies above the plane of the lower surface of base plate 32, but below both the planes of the mid-plate thickness and upper surface of plate 32. The lower margin of tip 80 lies in a plane below the plane of the lower surface of base plate 32. As such, it is thought that the resulting action of the work material across segments 66, 68 may tend to wear away segments 66, 68 less severely than if the tip had been placed in a higher plane, such as at or above the plane of the upper surface of plate 36. Further, it is thought that placement of the tip in this lower plane may tend to encourage self-sharpening of the leading edges of wear plates 66, 68.

When the wear of lip wear segment 34 is such that the rear portion of wear-indicating hole 136 is visible from the front of the loader, the lip wear segments need to be replaced to ensure that additional use does not result in damage to the forward portion of base plate 32. Lip wear segments are removed by removing the bolts connecting base plate 32 to lip wear segments 66, 68 and are replaced with new lip wear segments. As well, in a similar fashion, wing wear segments 38 can be replaced at this time.

Method of Use

An aspect of this invention is directed to a method of providing sets of lip wear segments to consumers. This method includes three main steps. In the first step, a retailer or distributor obtains numerous lip wear members having widths of 20 inches, 18 inches, 16 inches and 14.5 inches (although a variety of other sizes may be used). The retailer then determines for a given base plate width, which combination of lip wear members would give a total lip wear member width equal to the given base plate width. This determination may be done by simple calculation or by consulting prepared charts or other materials. The retailer then supplies the lip wear segments in the selected combination to consumers in kit form, ready for installation. The dealer may, optionally accept the worn teeth for return.

In the preferred embodiment, although different widths of wear segments 66, 68 are available, each has two lower flange bore holes, and the spacing of those bore holes is the same for all sizes, the differences in width being accounted for by a change in the width of the portion of the wear segment lying laterally outboard of each of the bore holes. This may tend to facilitate manufacture.

Another aspect of this invention is directed to a method of providing base plates for use with boltable lip wear segments. The base plates may be provided separately or in a kit with the boltable lip wear segments. The base plates may preferably be pre-cut to match the width of standard bucket sizes. The base plates may also preferably have bolt holes 64 predrilled to match the bolt holes of the boltable lip wear segments.

A number of changes may be made to the above invention. For example, a single large lip wear segment could be used instead of a combination of smaller lip wear segments. In addition, different profile configurations of the leading edge tip of the lip wear segment may be used for different applications. As well, the recess in the lip wear segment and the corresponding leading edge of the base plate may have different configurations to reduce stress concentrations. In addition, other edge profiles may be used for the wing wear segments. Further, the base plate may be formed integrally with the loader bucket.

Although the wear plate segments are attached to the base plate and side plate adapter fittings using releasably threaded mechanical fasteners in the nature of bolts, those bolts are to be taken as being representative of other types of fasteners such as huck bolts, hot forged rivets, cold formed rivets and so on. Releasably threaded bolts are preferred since, unlike rivets, they can be removed relatively easily without destroying the fastener.

In summary, from the foregoing description it can be seen that each wear lip segment 66, 68, has a straight leading edge abutment, namely tip 80, from which it increases in thickness in the rearward direction. The, increases in depth of the leading portion of the wear segment (measured by divergence of the lower plane, or surface 116 relative to the horizontal plane of base plate 32) in a uniform, or linear manner, while the upper surface follows the profile of an arc $R_2$. At the rear, the wear lip segment has a lower flange, leg 84 and an upper flange, leg 82. The upper flange is shorter than the lower flange, and thus may tend to provide a lesser obstruction to the flow of materials in and out of bucket 20 generally. The upper flange, leg 82 is shorter and thinner than the lower flange, lower leg 84, and thus may tend to provide a lesser obstruction to the flow of materials into and out of the bucket. The upper flange includes semi-circular recesses, namely allowances 100, 102 that are concentric with each bolt hole location in the corresponding position in the lower flange, thus tending to provide bolt hole access from above. The recesses, namely allowances 100, 102 are smoothly radiused into the trailing edge of the adjacent portions of the upper flange. The lower flange is thicker than the upper flange, and includes two spaced apart recessed, clearance holes to clear and protect the attaching bolt locknuts.

This single interface bolted connection between the lip bottom flange and the base plate may tend to provide for a relatively tightly held, relatively rigid connection, thereby may tend to reduce fatigue and may tend to reduce shear stresses in the bolts more generally. The resultant connection may tend to be a less time consuming procedure, and may tend to be less costly, than a welded connection.

The shaped recess between the upper and lower flanges at the rear portion of lip wear segment 66 or 68, namely groove 86, is defined by the lower surface of upper leg 82 and the upper surface of the lower leg 84, the narrow front abutment, (item 96), and the tapered, or oblique, plane 98 that extends rearwardly from the lower edge of abutment, (item 96). This recess is precision machined to match very closely, and preferably precisely, the machined left and right hand leading edges 50, 52 of base plate 32.

As noted above, a wear indicating hole 136 is provided in each of segments 66, 68 as a means of indicating the extent of wear, and may indicate that a replacement time is due prior to damaging or wearing into base plate 32. Base plate 32 can be of variable thickness depending on the size of bucket 20 or type of application. The rear base line of base plate 32, which runs parallel to the bucket rear edge, 46, is pre-machined with a weld preparation chamfer 48 as shown in FIG. 6. This chamfer extends along the full length of the plate and is used for the continuous welding connection between bucket 20 and base plate 32.

As has been described above, the base plate front, or leading edges 50, 52 are machined to suit the desired lead angle a and to match the lip wear recesses, grooves 86, drilled to conform to the selected lip wear segments, bolts, diameter and locations. The base plate forward edges 50, 52 are machined to form the wedge shape. The edge is tapered down and back from the narrow abutment and all sharp corners along the abutment are machined smooth. The two triangular wing attachments 36 may be cast or fabricated from abrasion resistant materials. The triangular opposed adjacent corner wear attachments 36 include recesses on the outer edges to facilitate welding to the inside and outside lines of the bucket vertical front corner and the topsides of the base plate 32. The center sections of the wing segments 38 are drilled with two holes to match the wing wear segment 38 bolt size (item 150) and locations. The center web (item 166) of the wing segment attachment 36 is made to fit inside the rearward recess of the wing segment 38. The cast wear wing segments 38 have a narrow front abutment that slopes outwardly towards the rear and includes a recess (socket 184) that fits over the wing segment center rib, namely item 166. Two holes are drilled through the rear flanges of the wing wear segments to match the bolt hole locations on the wing segment. The inner hole is countersunk to match the countersunk bolt head and the outer hole is recessed to completely clear and enclose the bolt locknut as shown in FIG. 5. High strength countersunk bolts and lock nuts are used throughout the assembly.

An embodiment of the invention has now been described in detail. Since changes in and or additions to the above-described best mode may be made without departing from the nature, spirit or scope of the invention, the invention is not to be limited to those details.

FIGS. 8-13 illustrate a further embodiment. Opposed wing segments 244 at each lower side corner of the assembly are welded onto the bucket assembly to provide improved scooping ability. The wing segments 244, seen in FIGS. 8 and 11, each are generally L-shaped in front elevation, comprising a triangle-shaped vertical side plate 246 and a horizontal floor plate 248. The vertical plate 246 forms a gusset-like extension of the vertical end walls 28, 30 of the bucket 20 to effectively increase the bucket carrying capacity. The floor plate 248 has a cross sectional front to rear configuration (in side view) identical or substantially identical to the base plate including a tapered forward edge 245 to snugly receive a lip wear segments 66 or 68, described below. The forward edge 245 protrudes forwardly of the side plate, in order to permit the lip wear segments 66 or 68 to protrude or overhang laterally beyond the edge of the wing segment 244. This permits use of a variety of sizes of wear segments 66 or 68 without being required to precisely fit between the opposed wing segments 244. A rearward-facing edge 250 of the wing 244 is bevelled for welding to the corresponding lower corner of the bucket 210. The floor plate 248 extends inwardly from the side plate and fits within a cut-out region of the base plate 32 such that when welded to the base plate, the floor and base plates form a substantially monolithic plate. In plan view, the floor plate 248 is generally rectangular, but with its inside rear corner 251 being angled to abut with an outwardly flared region 253 of the base plate 32. The inside edge 254 of the plate 248 abuts the outer side edge 255 of the base plate 32 and is welded thereto for a rigid attachment. When these two plates are joined, they effectively form a monolithic member with flush upper and lower surfaces and a continuous bevelled front edge. Hence, the bucket 20, base plate 32 and wing segments 244 when welded together effectively form a rigid monolithic unit. The corners are protected from wear by replaceable corner wear shrouds 257 which are bolted over the side plates 246 of the wing segments 244. The exposed upper edge 254 of the segments 244 may be bevelled.

The wing segments 244 include reinforced exterior flanges 259 which protrude downwardly and laterally outwardly from the base plate thereby providing further wear protection.

Figure 14:
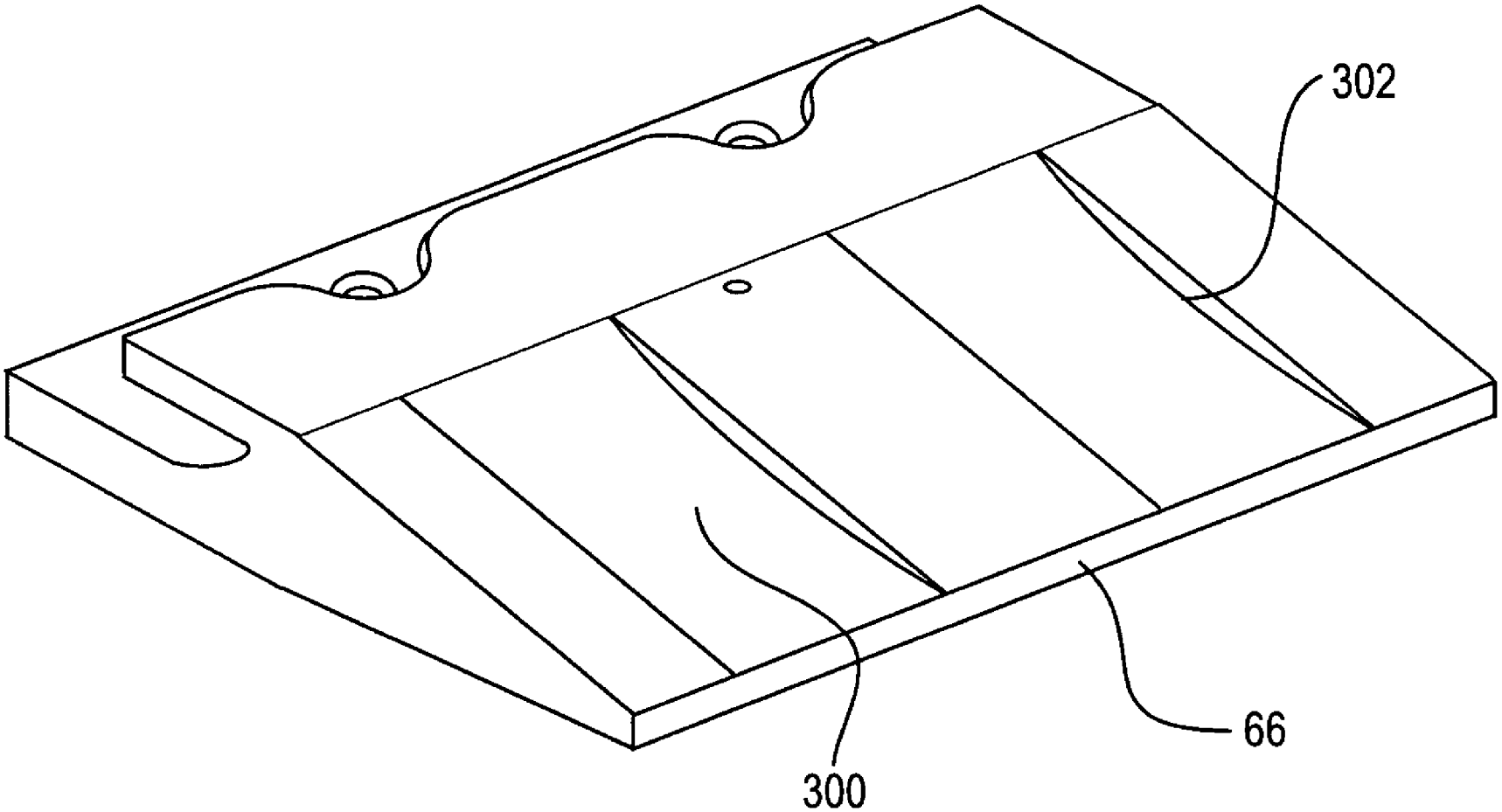
FIG. 14 is a perspective view of another embodiment of the lip wear protector.

FIG. 14 illustrates another version of the lip wear segments 66 and 68. In this version, the upper surface of the segment includes two spaced apart recesses 300 set into the upper surface which extend longitudinally from the front edge of the segment 60. The recesses 300 are rectangular in plan view, and have a curved bottom 302. The recesses 300 provide an enhanced scooping action which is useful in some applications. As well, the recessed portions will tend to wear more rapidly than the non-recessed regions, resulting in the formation of an irregular leading edge similar to the embodiment next described.

Figure 15:
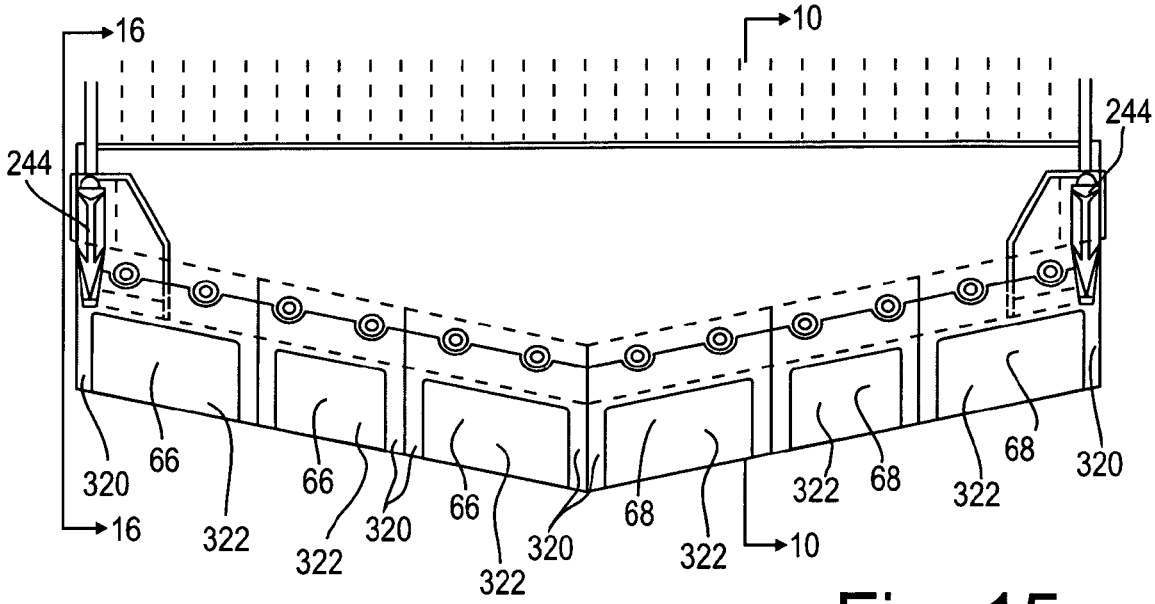
FIG. 15 is a top plan view of a further embodiment.
Figure 16:
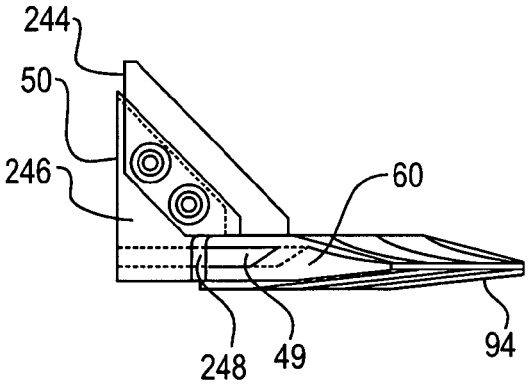
FIG. 16 is a side elevational view of the embodiment of FIG. 15, as viewed from the direction illustrated by line 16-16 of FIG. 15.
Figure 17:
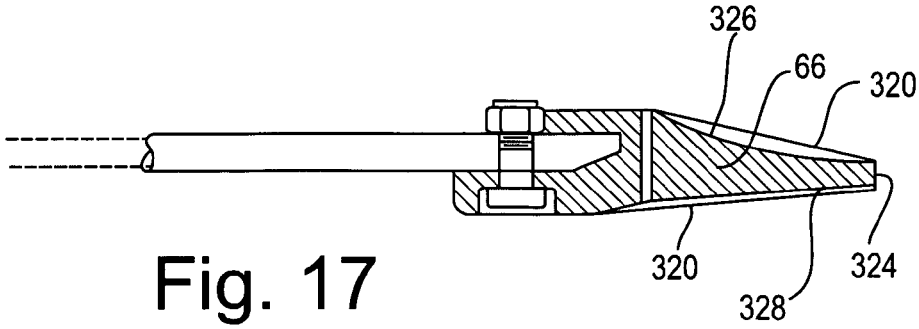
FIG. 17 is a cross-sectional view of the embodiment of FIG. 15, viewed along line 10-10 of FIG. 15.

FIGS. 15-17 illustrate yet another embodiment of the invention, in which the lip wear segments 66 and 68 have generally the same parallelogram configuration in plan view, but wherein each segment 66, 68 comprises thickened ribs 320 extending along the lateral side edge regions thereof. As before, segments 66 and 68 define right- and left-hand fittings for the bucket assembly. The portion of the segment lying between these side ribs forms a relatively thinner web 322. As will be seen from the cross sectional view of FIG. 16, the side ribs 320 have substantially flat upper and lower surfaces tapering inwardly and forwardly towards a squared front edge 324, while the inter-rib web 322 has an arcuate, upwardly concave upper surface 326. The lower surface 328 of the web region is substantially flat. Preferably, both upper and lower surfaces of the web are recessed relative to the ribs, although it is also contemplated that only the upper surface is thus recessed. In operation, the relatively thin forward region of the inter-rib web 322 will wear relatively quickly in comparison with the side ribs 320 and will thus effectively recess through use in the region between the ribs. The ribs 320 will thus protrude outwardly relative to the web regions 322 between the ribs, effectively forming forwardly-protruding teeth to aid in penetration of a muck pile and to provide increased wear resistance. As well, the ribs assist in the muck-scooping process by directing muck directly rearwardly and limiting travel of the muck laterally towards the wing segments thereby minimizing wear. As seen in FIGS. 17 and 18, the wing segments 244 of the third embodiment may be substantially the same as those of the second embodiment.

The invention claimed is:

1. A lead plate assembly for attachment to an excavator bucket, said excavator bucket comprising:

a backshell and a pair of opposed end walls mounted thereto;

said back shell and said end walls defining a bucket cavity having a width;

said backshell having a lower portion;

said end walls being spaced from each other a distance defining a width of said loader bucket, said lead plate assembly comprising:

a base plate mounted to said lower portion of said backshell, said base plate extending forwardly thereof, said base plate having a width extending across the width of said loader bucket;

said base plate having a leading edge, a first surface oriented inwardly relative to said backshell and a second surface oriented outwardly relative to said backshell;

said base plate having bores defined therethrough, said bores being inset from said leading edge;

at least one wear segment mounted to said base plate, said wear segment having a leading edge having upper and lower surfaces and oriented forwardly away from said base plate, said lower surface including a region tapering upwardly and forwardly towards said upper surface and forwardly;

said wear segment having a trailing portion having an accommodation for said leading edge of said base plate; and said leading edge of said base plate having a male profile;

said accommodation of said wear segment having a female profile matching said male profile of said leading edge of said base plate, including said tapering region, said female profile including a first portion engaging said first surface of said base plate and a second portion engaging said second surface of said wear plate;

said wear segment having at least one bore formed therein, said bore of said wear segment and a corresponding one of said bores of said base plate being aligned when said male and female profiles are engaged; and said wear segment and said base plate being connected at said aligned bores by an impermanent mechanical fastener mounted across a single connection interface, wherein said trailing portion of said wear segment includes first and second spaced apart flanges and a root section from which said flanges extend rearwardly, said flanges and said root co-operating to define said accommodation.

2. The assembly of claim 1 wherein:

when said loader bucket rests with said base plate adjacent a ground surface, said first flange is an upper flange and said second flange is a lower flange;

said lower flange extends further rearwardly than said upper flange;

said bores of said wear segment are formed in said lower flange;

said upper flange has tool access accommodations formed therein adjacent said bores of said lower flange.

3. The assembly of claim 2 wherein said bores of said lower flange have centerlines lying in a plane, and said upper flange has a rearward edge lying abreast of the plane of the centerlines.

4. The assembly of claim 1 comprising a plurality of said segments having a combined width corresponding to the width of the base plate.

5. The assembly of claim 1 wherein:

said base plate has a central point and left and right hand leading edges trailing rearwardly and outwardly from said point; and said assembly includes a plurality of said wear segments, half of said segments being left handed, and half of said segments being right handed.

6. The assembly of claim 1 wherein, when said bucket assembly is resting with said base plate on a ground surface, said first surface of said base plate is an upper surface, and said leading edge of said wear member includes a tip having an abutment intersecting said plane of said second surface of said base plate.

7. The assembly of claim 1 wherein all of said bores in said base plate are on a uniform setback distance from said leading edge.

8. The assembly of claim 1 wherein said wear segment includes an upper surface extending rearwardly from said tip of said wear segment, and said upper surface is scalloped to encourage rolling action in the work material.

9. The assembly of claim 1 wherein said wear segment has at least two of said bores formed therein, and said wear segment is connected to said base plate by at least two of said impermanent mechanical fasteners.

10. The assembly of claim 9 wherein said impermanent mechanical fasteners are threaded fasteners.

11. The assembly of claim 10 wherein said at least two bores are spaced apart and stand at a common setback distance relative to said leading edge of said base plate.

12. The assembly of claim 1 wherein said wear segment has a pair of side faces, said side faces lying in parallel vertical planes, said vertical planes being oriented in a fore-and-aft direction relative to said width of said bucket.

13. The assembly of claim 1 wherein:

said base plate has a central lead point and left and right hand leading edges tapered sideways outwardly and rearwardly;

a plurality of left handed wear segments is mounted side-by-side along said left hand leading edge;

a plurality of right hand wear segments is mounted side-by-side along said right hand leading edge; and at least one of said left hand wear segments has a leading abutment tip running parallel to said left hand leading edge and a pair of parallel side faces extending in a fore-and-aft orientation relative to the width of said bucket.

14. The assembly of claim 1 further comprising a loader bucket for attachment with said base plate.

15. The assembly of claim 2 wherein said lower flange and said upper flange each have a thickness when seen in cross-section, the thickness of said lower flange being generator than that of said upper flange.

16. The assembly of claim 1 further comprising:

wear segment attachment fitting for mounting to vertical edges of side walls of the bucket, and shrouds for mounting to said wear segment attachment fitting;

said shrouds each include a pair of rearwardly extending parallel flanges and a rearwardly facing slot defined therebetween;

said attachment fittings each include a forwardly facing web;

said web and said slot being matable; and said web and one of said flanges having corresponding bores formed therein to admit a fastener to connect each said shroud to a respective side wear segment attachment fitting in single shear.

17. A replaceable wear segment for impermanent mating with a leading edge of a base plate of a loader bucket assembly, the base plate having apertures formed therethrough adjacent to said leading edge, wherein said wear segment comprises:

a body having a leading portion and a trailing portion;

said trailing portion having a pair of first and second upper and lower spaced apart flanges, said flanges having proximal ends joined at a root, and distal ends extending rearwardly of the root, the lower of said flanges tapering upwardly at said proximal end;

said first and second flanges having respective opposed faces lying in respective first and second spaced apart parallel planes;

said opposed faces and said root co-operating to define a rearwardly facing socket having a profile to match the leading edge of the base plate;

said socket admitting sliding entry of the base plate between said flanges;

said socket admitting sliding entry of the base plate between said flanges; and said second flange having an aperture defined therein to admit an impermanent mechanical fastener to be inserted therethrough, and through an aperture of the base plate for impermanent single flange connection of the wear segment to the base plate.

18. The wear segment of claim 17 wherein:

when said first flange rests on a ground surface, said first flange is an upper flange and said second flange is a lower flange;

said lower flange extends further rearwardly than said upper flange;

said bores of said wear segment are formed in said lower flange; and said upper flange has tool access accommodations formed therein adjacent said bores of said lower flange.

19. The wear segment of claim 18 wherein said apertures of said lower flange have centerlines lying in a plane, and said upper flange has a rearward edge lying abreast of the plane of the centerlines.

20. The wear segment of claim 17 wherein said wear segment includes an upper surface extending rearwardly from said tip of said wear segment, and said upper surface is scalloped to encourage rolling action in the work material.

21. The wear segment of claim 17 wherein said wear segment has at least two of said bores formed therein.

22. The wear segment of claim 21 wherein said at least two bores are spaced apart and stand at a common setback distance relative to said leading edge of said base plate.

23. The wear segment of claim 17 wherein the lower of said flanges is thicker than the upper of said flanges when measured between said faces thereof.

24. The wear segment of claim 17 wherein:

said leading portion of said segment has first and second diverging flanks extending rearwardly of said tip thereof;

said first flank extends from said tip toward said first flange;

said second flank extend from said tip toward said second flange; and said first flank has a surface having a convex profile relative to said second flank.

25. The combination of claim 24 wherein:

said leading portion of said segment includes an abutment face; said abutment face and said first flank meet along a vertex;

said vertex lies between said first and second planes; and said vertex lies closer to said second plane than to said first plane.

26. The combination of claim 25 wherein:

said leading portion includes an abutment face;

said abutment face and said first flank meet at a first vertex;

said abutment face and said second flank meet along a second vertex; and said first vertex lies to one side of said second plane, and said second vertex lies to the other side of said plane.

27. The wear segment of claim 17 comprising substantially parallel side edges, a central web therebetween and a front edge, the side edge regions of said segment being thicker than the central web, said central web having a generally arcuate upper surface such that said thicker side regions form a rib projecting upwardly relative to said central web, said central web being adapted to wear more quickly than side regions such that said side regions form forwardly projecting points upon use of said assembly.

28. The segment of claim 27, wherein the lower face of said central region angles downwardly and rearwardly.

29. The segment of claim 27, wherein said thickened side regions have substantially flat upper and lower surfaces.

* * * * *